US012252453B2

(12) United States Patent
Casebier et al.

(10) Patent No.: US 12,252,453 B2
(45) Date of Patent: Mar. 18, 2025

(54) CORELESS-COIL SHOCK TUBE SYSTEM WITH REDUCED NOISE

(71) Applicant: Ensign-Bickford Aerospace & Defense Company, Simsbury, CT (US)

(72) Inventors: Micah S. Casebier, Bremen, CT (US); Ronald M. Dufrane, West Granby, CT (US); Scott Crespi, West Hartford, CT (US)

(73) Assignee: Ensign-Bickford Aerospace & Defense Company, Simsbury, CT (US)

( * ) Notice: Subject to any disclaimer, the term of this patent is extended or adjusted under 35 U.S.C. 154(b) by 0 days.

(21) Appl. No.: 18/528,291

(22) Filed: Dec. 4, 2023

(65) Prior Publication Data

US 2024/0116834 A1 Apr. 11, 2024

Related U.S. Application Data

(63) Continuation of application No. 17/512,940, filed on Oct. 28, 2021, now Pat. No. 11,845,703, which is a continuation of application No. 16/814,084, filed on Mar. 10, 2020, now Pat. No. 11,192,832.

(60) Provisional application No. 62/908,652, filed on Oct. 1, 2019.

(51) Int. Cl.
*C06C 5/04* (2006.01)
*F42D 1/04* (2006.01)

(52) U.S. Cl.
CPC ..... *C06C 5/04* (2013.01); *F42D 1/043* (2013.01)

(58) Field of Classification Search
CPC ..... C06C 5/04; F42D 1/043
USPC ..... 102/275.1
See application file for complete search history.

(56) References Cited

U.S. PATENT DOCUMENTS

| | | | | |
|---|---|---|---|---|
| 1,631,756 A | | 6/1927 | Olin | |
| 2,514,542 A | | 7/1950 | Guest | |
| 3,590,739 A | | 7/1971 | Persson | |
| 4,102,428 A | | 7/1978 | Kelly et al. | |
| 4,166,418 A | | 9/1979 | Calder, Jr. | |
| 4,232,606 A | * | 11/1980 | Yunan | C06C 5/04 102/275.8 |

(Continued)

FOREIGN PATENT DOCUMENTS

| | | |
|---|---|---|
| CA | 2118528 A1 | 4/1995 |
| EP | 3251970 A1 | 12/2017 |

(Continued)

OTHER PUBLICATIONS

U.S. Appl. No. 16/814,084, filed Mar. 10, 2020, U.S. Pat. No. 11,192,832, Issued.

(Continued)

*Primary Examiner* — Samir Abdosh
(74) *Attorney, Agent, or Firm* — McCarter & English, LLP; Dave S. Christensen

(57) ABSTRACT

A shock tube package system and a method of deploying a shock tube package system is provided. The system includes a covering made from a flexible or elastic material, the covering defining an interior portion. A bundle of shock tubing is disposed within the interior portion, the covering applying a compression fit on the bundle of shock tubing. The bundle of shock tubing having a first end and a second end, the first end being configured to couple with an initiator device, the second end being configured to couple with a detonator.

14 Claims, 3 Drawing Sheets

(56) References Cited

U.S. PATENT DOCUMENTS

| | | | | |
|---|---|---|---|---|
| 4,328,753 | A | 5/1982 | Kristensen et al. | |
| 4,699,059 | A | 10/1987 | Kelly et al. | |
| 5,147,040 | A | 9/1992 | Koike et al. | |
| 5,555,978 | A | 9/1996 | Elsner | |
| 5,597,973 | A | 1/1997 | Gladden et al. | |
| 5,622,030 | A | 4/1997 | Steed et al. | |
| 5,714,712 | A | 2/1998 | Ewick et al. | |
| 6,272,996 | B1 | 8/2001 | O'Brien et al. | |
| 7,086,335 | B2 | 8/2006 | O'Brien et al. | |
| 7,650,993 | B2 * | 1/2010 | Bawabe | F42B 39/00 102/275.1 |
| 8,123,027 | B2 * | 2/2012 | Kirkham | A45C 15/00 190/111 |
| 8,684,178 | B1 | 4/2014 | Solomon | |
| 9,470,571 | B2 | 10/2016 | Huang et al. | |
| 10,473,323 | B2 | 11/2019 | Squashic et al. | |
| 10,996,038 | B2 | 5/2021 | Johnson et al. | |
| 11,192,832 | B2 * | 12/2021 | Casebier | C06C 5/04 |
| 11,554,998 | B2 | 1/2023 | Casebier et al. | |
| 11,845,703 | B2 | 12/2023 | Casebier et al. | |
| 2004/0200372 | A1 | 10/2004 | Gladden | |
| 2005/0034748 | A1 | 2/2005 | Gadd et al. | |
| 2006/0144279 | A1 * | 7/2006 | Bawabe | F42B 39/30 102/275.12 |
| 2010/0018426 | A1 * | 1/2010 | Kirkham | F42B 39/26 190/115 |
| 2013/0327681 | A1 | 12/2013 | Andre et al. | |
| 2014/0036519 | A1 | 2/2014 | Cloward | |
| 2017/0122710 | A1 | 5/2017 | Scheid et al. | |
| 2018/0080750 | A1 * | 3/2018 | Olivares | B65D 85/04 |
| 2018/0106583 | A1 | 4/2018 | Montaño Rueda et al. | |
| 2020/0318938 | A1 * | 10/2020 | Johnson | F42D 1/043 |
| 2021/0094890 | A1 * | 4/2021 | Casebier | C06C 5/04 |

FOREIGN PATENT DOCUMENTS

| | | | |
|---|---|---|---|
| SE | 399766 | B | 2/1978 |
| WO | 2018/188690 | A1 | 10/2018 |
| WO | 2019/004495 | A1 | 1/2019 |

OTHER PUBLICATIONS

U.S. Appl. No. 17/118,973, filed Dec. 11, 2020, U.S. Pat. No. 11,554,998, Issued.

U.S. Appl. No. 17/512,940, filed Oct. 28, 2021, U.S. Pat. No. 11,845,703, Issued.

* cited by examiner

CORELESS-COIL SHOCK TUBE SYSTEM WITH REDUCED NOISE

CROSS REFERENCE TO RELATED APPLICATIONS

The present application is a continuation application of U.S. patent application Ser. No. 17/512,940 filed on Oct. 28, 2021, which is a continuation application of U.S. patent application Ser. No. 16/814,084, filed on Mar. 10, 2020 (now U.S. Pat. No. 11,192,832), which is a nonprovisional application of U.S. Provisional Application Ser. No. 62/908,652, the contents of which are incorporated by reference herein

BACKGROUND

The subject matter disclosed herein relates to igniting devices and systems for explosives and, more particularly, to fuse cord and packaging for fuse cord.

Shock tubes are a type of fuse cord or blasting cord used in non-electric blast initiation systems. Shock tubing typically comprises an elongated, hollow, flexible, small-diameter tube, the inner surface of which is coated with a reactive substance, e.g., a thin layer of detonating or deflagrating explosive composition. Most commonly, this composition consists of a mixture of HMX and aluminum powder. Other shock tube designs encompass multiple plastic layers to provide improved tensile strength and abrasion resistance.

In commercial blasting applications, the shock tubing provides a signal transmission device to transmit a signal to multiple blasting caps in mining or quarrying applications. When initiated, the interior coating of the shock tube transmits a low energy shock wave that travels down the interior of the tube, but without breaching the tube sidewall. A detonator affixed to the end of the tubing is initiated by the shock wave, thereby setting off an attached explosive charge. In military applications shock tube-based initiation systems are used because of their relative safety. In particular, since the system is non-electric, it is not affected by stray electrical currents so cannot be accidentally initiated by electrical signals. Also, the system does not require special electrical blasting machines as would be required if an electric blasting cap system was used.

In commercial applications, a firing device containing a percussion primer is typically used to initiate the shock tube. For military applications, a self-contained system is desirable. In military systems, an end fitting can be used to position a percussion primer on the end of the shock tube.

In the field, a spring-loaded firing pin device is typically attached to the assembly and used to fire the percussion primer for initiating the shock tube.

Still other shock tubes have been developed for the military with the firing device permanently affixed to the shock tube lead in the factory. This results in a totally self-contained initiation system being delivered in one package to the field. The length of shock tube on a spool can vary from 80 feet to 1,000+ feet. The length of shock tube allows the field blaster to retreat a safe distance between the charge the detonator is initiating and the firing device that initiates the blast. This system is very robust and useful and has been deployed extensively in military field applications. However the use of a spool (and, of course, box) greatly increases the overall weight and volume of the shock tube package. For covert operations, it is extremely desirable to have a self-contained detonator assembly that is easily carried by a person or one that will fit into a pocket on a vest.

It should be appreciated that in covert operations it is desired to keep noise associated with the deployment of the shock tube to maintain an element of surprise during a mission. Without being limited by any theory, it has been found that in some instances the rubbing of the shock tube against the washers or end plates of the shock tube assembly, including the heat shrink skin, creates a resonance that amplifies the sound level.

Accordingly, while existing shock tubes are suitable for their intended use the need for improvement remains, particularly in providing a shock tube that generates less noise during deployment.

BRIEF DESCRIPTION

According to one aspect of the disclosure a shock tube package system is provided. The system includes a coreless bundle of shock tubing. The system further includes an outer covering disposed about the periphery of the bundle of shock tubing.

According to another aspect of the disclosure, a shock tube system is provided. The system includes a covering made from a flexible or elastic material, the covering defining an interior portion. A bundle of shock tubing is disposed within the interior portion, the covering applying a compression fit on the bundle of shock tubing, the bundle of shock tubing having a first end and a second end, the first end being configured to couple with an initiator device, the second end being configured to couple with a detonator.

In addition to one or more of the features described herein, or as an alternative, further embodiments of the system may include the covering having a first opening adjacent the first end and a second opening adjacent the second end, at least one of the first opening or second opening being configured to expand to allow insertion of the bundle of shock tubing.

In addition to one or more of the features described herein, or as an alternative, further embodiments of the system may include an initiator device coupled to the first end.

In addition to one or more of the features described herein, or as an alternative, further embodiments of the system may include the initiator device being removably coupled to the cover.

In addition to one or more of the features described herein, or as an alternative, further embodiments of the system may include the initiator device being movably coupled to an exterior surface of the cover.

In addition to one or more of the features described herein, or as an alternative, further embodiments of the system may include a detonator device coupled to the second end, the detonator device being removably disposed within the interior portion.

In addition to one or more of the features described herein, or as an alternative, further embodiments of the system may include the bundle of shock tubing includes a portion adjacent the second end, the portion extending through the second opening.

In addition to one or more of the features described herein, or as an alternative, further embodiments of the system may include a pull string or tab operably coupled to the detonator, the pull string or tab extending at least partially through the second opening.

In addition to one or more of the features described herein, or as an alternative, further embodiments of the system may include the cover being made from a textile.

In addition to one or more of the features described herein, or as an alternative, further embodiments of the system may include the textile being made from one or more of cotton, nylon, polyester, or polyether-polyurea copolymer.

In addition to one or more of the features described herein, or as an alternative, further embodiments of the system may include the covering being made from a single piece of textile material.

In addition to one or more of the features described herein, or as an alternative, further embodiments of the system may include the covering being made from a plurality of components In addition to one or more of the features described herein, or as an alternative, further embodiments of the system may include the bundle of shock tubing having a coil of shock tubing having an inner diameter.

In addition to one or more of the features described herein, or as an alternative, further embodiments of the system may include a detonator removably coupled to the inner diameter In addition to one or more of the features described herein, or as an alternative, further embodiments of the system may include a plurality of successive short lengths of tubing folded back on one another.

These and other advantages and features will become more apparent from the following description taken in conjunction with the drawings.

BRIEF DESCRIPTION OF DRAWINGS

The subject matter, which is regarded as the disclosure, is particularly pointed out and distinctly claimed in the claims at the conclusion of the specification. The foregoing and other features, and advantages of the disclosure are apparent from the following detailed description taken in conjunction with the accompanying drawings in which:

The detailed description explains embodiments of the disclosure, together with advantages and features, by way of example with reference to the drawings.

DETAILED DESCRIPTION

Embodiments provided herein disclose a shock tube system that allows for deployment of a shock tube with lowered noise generation.

Figure 1:
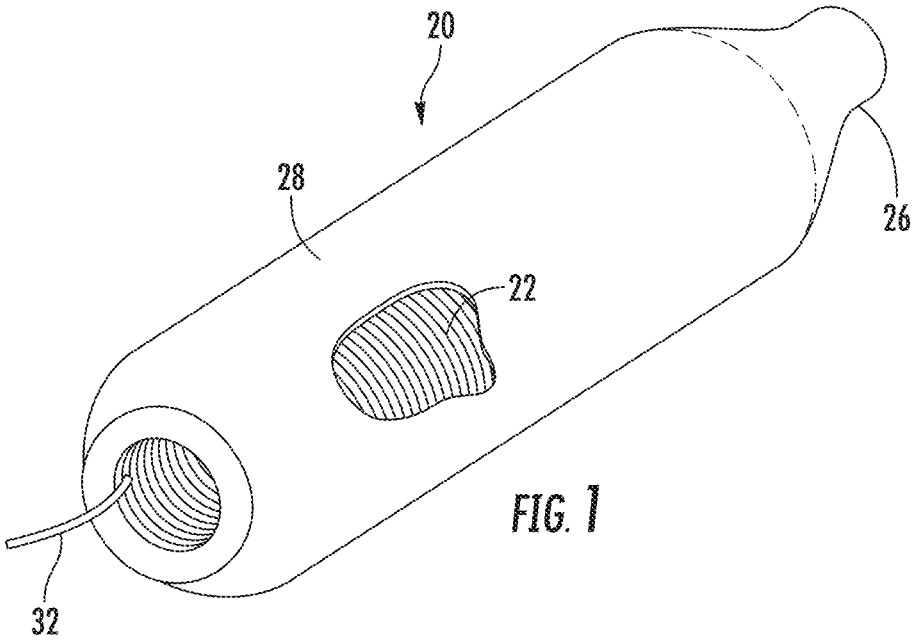
FIG. 1 is a perspective view of a coreless-coil shock tube system, according to an embodiment, showing an "outer" end of the shock tubing.
Figure 2:
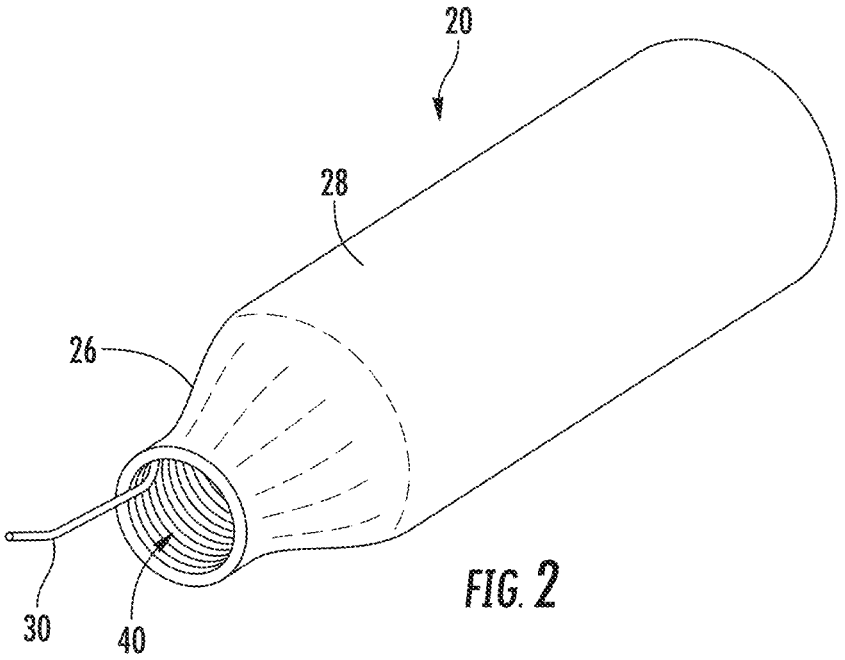
FIG. 2 is a perspective view of the shock tube system showing an "inner" end of the shock tubing.
Figure 3:
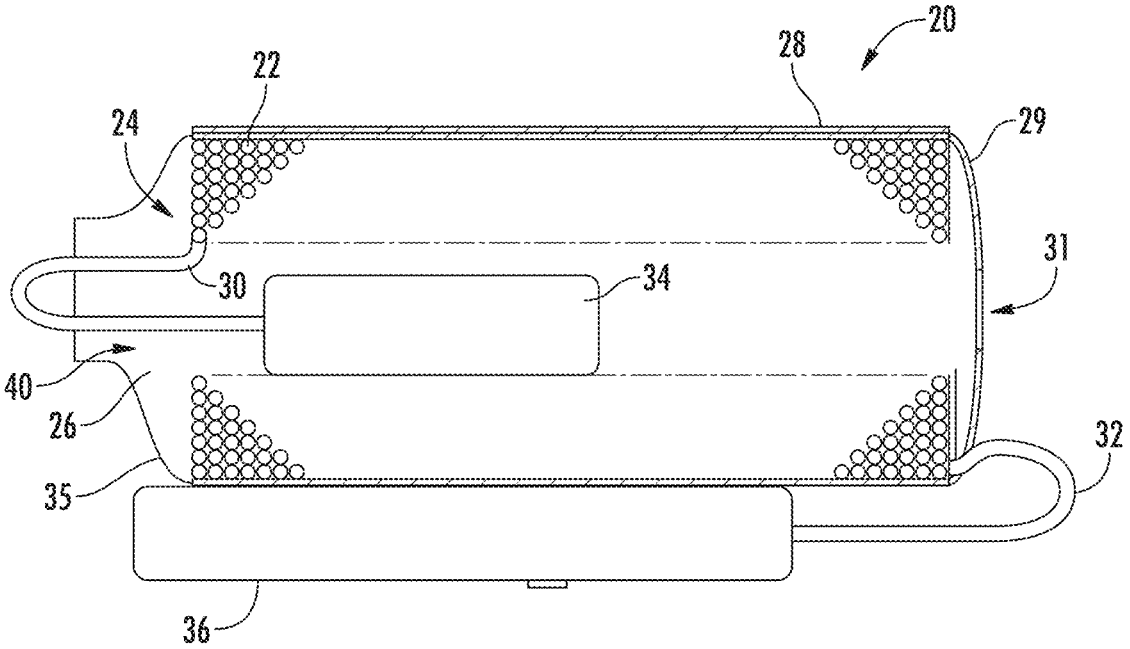
FIG. 3 is a lateral side elevation view of the shock tube system.

With reference to FIGS. 1-3, an embodiment of the present invention relates to a coreless-coil shock tube package system 20. The package system 20 includes a "coreless" bundle of shock tubing 22, by which it is meant that the tubing bundle 22 is not supported or contained by being wrapped around a spool or other supporting structure. The tubing bundle may be a generally cylindrical (in overall shape) coil of shock tube. Also, a flexible or elastic outer cover or envelope 28 at least partially covers or is disposed about the periphery of the coil 22.

In an embodiment, one end of the tubing 22 (the "inner" end 30) is positioned at the interior 24 of the coil 22, and the other end of the tubing (the "outer" end 32) is positioned on the outside of the coil. Alternatively (see FIG. 3), a detonator 34 is attached to the tubing's inner end 30 and is then tucked into the coil 22, through opening 40 in the outer cover 28, for convenient storage and transport. Also, a percussive initiator device ("igniter") 36 may be attached to the tubing's outer end 32 and secured in place against the outer covering 28. In an embodiment, the initiator device 36 is removably coupled to the outer cover 28 using a strap 33, such as an elastic band strap or a textile or fabric strap having a hook and loop fastener for example. In an embodiment, the connection means for holding the initiator device 36 is integrated into the outer covering 28.

Figure 4:
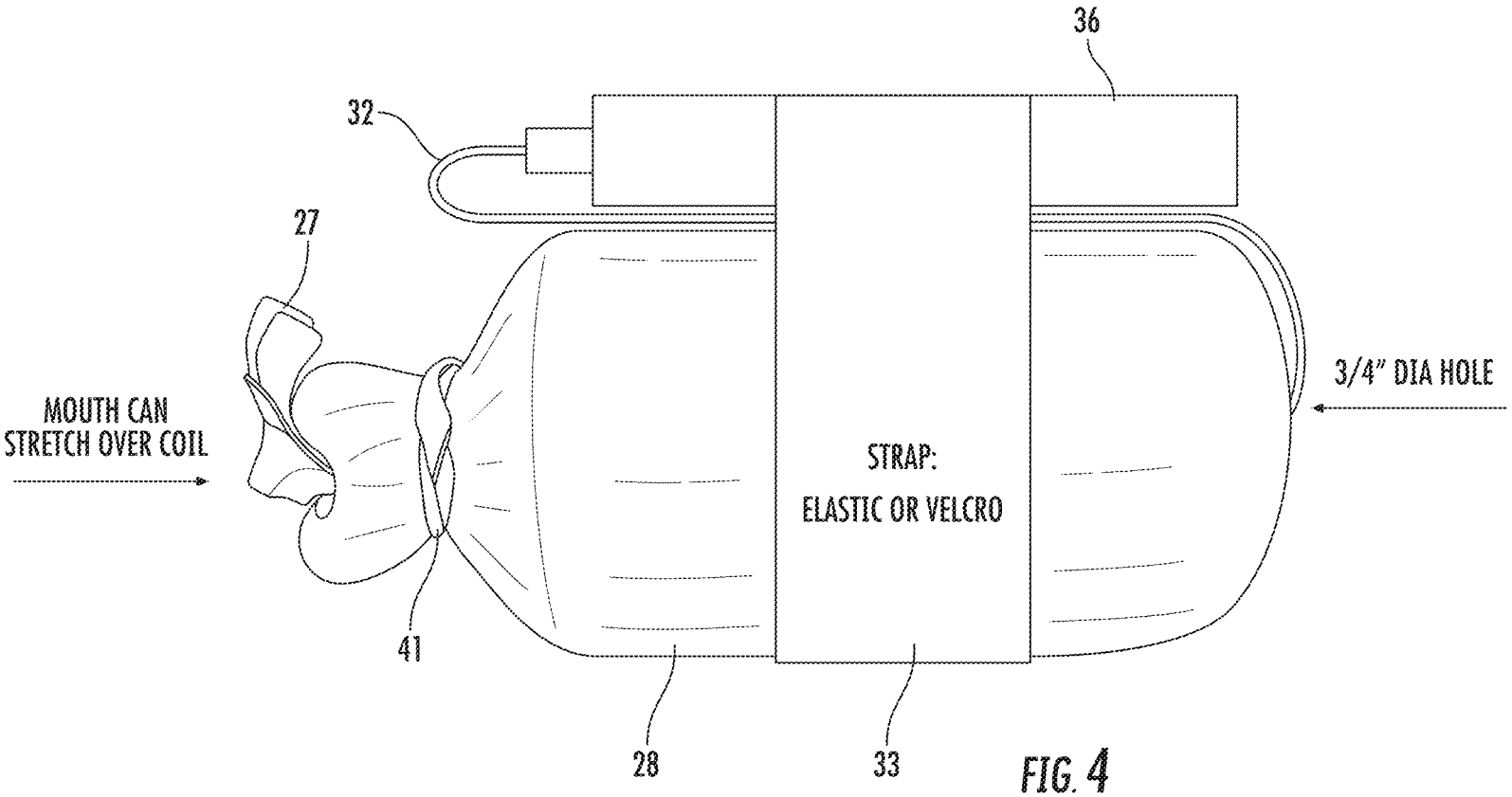
FIG. 4 is a lateral side elevation view of the shock tube system in accordance with another embodiment.

In use, the detonator 34 is removed from the coil 22 by pulling on a portion of the tubing 22 left protruding through a central hole 40 in the neck portion 26 of outer cover 280. Alternatively, a pull string or tab 27 (FIG. 4) may be attached to the detonator 34 or proximate tubing for use in removing the detonator from the coil interior 24. Then, the detonator 34 is attached to an explosive charge or device (not shown) in a conventional manner. To deploy the tubing 22, the coil package 20 is pulled away from the detonator and explosive, thereby uncoiling the tubing through the opening 40 and out of the outer covering 28. Then, once at a safe distance, the igniter 36 is actuated, igniting the shock tubing 22, which in turn actuates the detonator, igniting the explosive. It should be appreciated that in some embodiments, such as those used in military applications, it is desirable to uncoil the tubing with little noise.

The shock tube coil 22 can be any length as desired, from tens to hundreds of feet in length or more. The shock tubing 22 may be similar to that described in U.S. Pat. No. 4,328,753, or the shock tubing as described in U.S. Pat. No. 5,597,973, the contents of which are incorporated by reference herein their entirety. In this embodiment, the shock tubing 22 has an outside diameter between 0.08 inches and 0.12 inches. In an embodiment, the outside diameter may be 0.085 inches, 0.100 inches, or 0.118 inches. It should be appreciated that the dimensions provided herein are for example purposes and the size may be changed without deviating from the teachings herein, and the claims should not be so limited. This size of small-diameter shock tubing will yield the desired degree of resiliency and stress at the inside diameter of the coiled shock tubing, after removal from a mandrel in the manufacturing method described below. However, as should be appreciated, shock tubing with different diameters may be used.

The outer covering 28 may be a flexible or elastic material. In an embodiment, the outer covering 28 is made from a textile, such as cotton, nylon, polyester, a polyether-polyurea copolymer, or a combination of the foregoing. The outer covering includes a first end 29 having an opening 31. In an embodiment, the opening 31 is 0.75 inches (19.05 mm) is provided to allow a mandrel to pass therethrough during assembly. In an embodiment, the opening 31 allows the end 32 to exit the outer covering 28 and connect with the initiator device 36. In another embodiment, the end 32 exits the internal portion of the outer covering through a hole (not shown) near the periphery of the outer covering 28. The first end 29 and the opening 31 are configured to expand from a first size to a larger second size as the shock tube coils are inserted into the outer covering 28. The outer covering 28 further includes a second end 35 that includes the neck portion 26.

The neck portion 26 includes an opening 40. The neck portion 26 and opening 40 are configured to expand from a first size to a larger second size to allow the shock tube coils 22 to be inserted into the outer covering 28. After the shock tube coils 22 are inserted, the neck portion 26 and opening 40 return to the first size to retain the shock tube coils 22 within the outer covering 28. In an embodiment, the second end 35 is shaped like the first end 29 and does not include a neck portion 26. In an embodiment, the weave of the textile material of the outer covering 28 is configured to be elastic and to automatically reduces in size to the first size after the shock tube coils 22 are inserted. In an embodiment, the neck portion includes a section that extends about the circumference of the neck portion and is elastic, but stiffer, than the surrounding material. In another embodiment, an external elastic member 41 (FIG. 4) is placed around the neck portion 26 after the shock tube coils 22 have been inserted.

In an embodiment, the outer covering 28 is sized to provide a compression fit on the shock tube coils 22. In an embodiment, the outer covering 28 is formed from a single piece textile material. In another embodiment, the outer covering 28 may be formed by multiple components. The multiple components may be separate, integral, or coupled together. In an embodiment, the outer covering 28 is sized to form a compression fit over a 5-inch (127 mm) long×2¾ inch (70 mm) diameter cylinder. It should be appreciated that the cylinder may be larger or smaller. In an embodiment, the outer covering 28 may be formed from any suitable material that maintains a compression fit when exposed to a temperature range of +160 F to −60 F, including in some embodiment one or more of after temperature cycling, after a 10-foot drop, or after being submerged in water. In an embodiment, the material of the outer covering 28 is selected to provide a predetermined sound level when the shock tube coil is being removed during operation.

As noted, the detonator 34 is operably connected to the inner end 30 of the coiled shock tube 22. The detonator 34 may be a device made in accordance with U.S. Pat. No. 6,272,996, the contents of which are incorporated herein by reference. Also, the detonator 34 may be positioned inside the coil 22 for reducing the volume of the resulting package 20. The igniter 36 is operably connected to the outer end 32 of the tubing 22, and is held in place by a suitable means, such as an adhesive, an elastic member or a strap for example. The igniter 36 may be a device constructed in accordance with U.S. Pat. No. 6,272,996. Alternatively, the coreless-coil shock tubing package 20 may be provided without a detonator or igniter, in which case these or similar devices would be connected to the coil 22 by a user in the field or otherwise. The igniter and detonator are sometimes collectively referred to herein as "shock tube devices," by which it is meant a device either for actuating a shock tube or being acted upon by a shock tube signal.

As noted above, the shock tubing is provided as a "bundle," which refers generally to configurations where a length of shock tubing is wound in a compact manner or otherwise compactly arranged. Thus, the shock tubing bundle may be in the form of a coil, or, e.g., it could comprise successive short lengths of the tubing folded back over on one another. The bundle does not have to be cylindrical in overall shape, and could be other shapes. Thus, one embodiment may be characterized as packaged shock tubing comprising a bundle consisting of a compactly arranged length of shock tubing (e.g., no spool or other support) and a flexible or elastic outer covering that maintains the length of shock tubing in a bundled manner, e.g., in a compact arrangement.

Alternatively, the detonator 34 is attached to the inner end 30 of the tubing 22 and inserted into the opening provided at one end of the coil 22. Also, the igniter 36 may be attached to the outer end 32 of the tubing 22 and alternatively retained by a shrink-wrap layer or covering instead of via the strap, elastic member or adhesive.

As should be appreciated, instead of tucking in whichever device is attached to the inner tubing end, such device can be left on the outside of the coil and removably secured to, e.g., the end of the coil. Also, for use in certain applications, instead of attaching a detonator 34 to the inner end 30 of the tubing 22 and an igniter 36 to the outer end 32 of the tubing 22, the igniter may be attached to the inner end and the detonator to the outer end. In this configuration, the detonator and coil would remain with the explosive device while the igniter is moved away from both. It might also be the case that the igniter would remain stationary (e.g., held by a soldier or other user) while the coil and detonator are moved in a direction of interest.

The term "about" is intended to include the degree of error associated with measurement of the particular quantity based upon the equipment available at the time of filing the application. For example, "about" can include a range of ±8% or 5%, or 2% of a given value.

Additionally, the term "exemplary" is used herein to mean "serving as an example, instance or illustration." Any embodiment or design described herein as "exemplary" is not necessarily to be construed as preferred or advantageous over other embodiments or designs. The terms "at least one" and "one or more" are understood to include any integer number greater than or equal to one, i.e. one, two, three, four, etc. The terms "a plurality" are understood to include any integer number greater than or equal to two, i.e. two, three, four, five, etc. The term "connection" can include an indirect "connection" and a direct "connection".

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiment(s) may include only some of the described exemplary aspects. Accordingly, the disclosure is not to be seen as limited by the foregoing description, but is only limited by the scope of the appended claims.

What is claimed is:

1. A shock tube system comprising:

a covering made from a flexible or elastic material, the covering defining an interior portion;

a bundle of shock tubing disposed within the interior portion, the covering applying a compression fit on the bundle of shock tubing, the bundle of shock tubing having a first end and a second end, the first end being configured to couple with an initiator device, the second end being configured to couple with a detonator, wherein the covering includes a first opening adjacent the first end and a second opening adjacent the second end, at least one of the first opening or second opening being configured to expand to allow insertion of the bundle of shock tubing.

2. The system of claim 1, further comprising an initiator device coupled to the first end.

3. The system of claim 2, wherein the initiator device is removably coupled to the cover.

4. The system of claim 3, wherein the initiator device is movably coupled to an exterior surface of the cover.

5. The system of claim 2, further comprising a detonator device coupled to the second end, the detonator device being removably disposed within the interior portion.

6. The system of claim 5, wherein the bundle of shock tubing includes a portion adjacent the second end, the portion extending through the second opening.

7. The system of claim 5, further comprising a pull string or tab operably coupled to the detonator, the pull string or tab extending at least partially through the second opening.

8. The system of claim 1, wherein the cover is made from a textile.

9. The system of claim 8, wherein the textile is made from one or more of cotton, nylon, polyester, or polyether-polyurea copolymer.

10. The system of claim 8, wherein the covering is made from a single piece of textile material.

11. The system of claim 8, wherein the covering is made from a plurality of components.

12. The system of claim 1, wherein the bundle of shock tubing comprises a coil of shock tubing having an inner diameter.

13. The system of claim 12, further comprising a detonator removably coupled to the inner diameter.

14. The system of claim 1, wherein the bundle of shock tubing comprises a plurality of successive short lengths of tubing folded back on one another.

* * * * *